US010477999B1

(12) United States Patent
Tabb

(10) Patent No.: US 10,477,999 B1
(45) Date of Patent: Nov. 19, 2019

(54) DOUBLE-LAYERED THERMAL INSULATION SLEEVE

(71) Applicant: Larry Tabb, Atlanta, GA (US)

(72) Inventor: Larry Tabb, Atlanta, GA (US)

( * ) Notice: Subject to any disclaimer, the term of this patent is extended or adjusted under 35 U.S.C. 154(b) by 192 days.

(21) Appl. No.: 15/330,498

(22) Filed: Sep. 28, 2016

Related U.S. Application Data

(60) Provisional application No. 62/284,417, filed on Sep. 29, 2015.

(51) Int. Cl.
*A47G 23/02* (2006.01)
*B65D 81/38* (2006.01)

(52) U.S. Cl.
CPC ..... *A47G 23/0216* (2013.01); *B65D 81/3876* (2013.01); *A47G 2023/0291* (2013.01)

(58) Field of Classification Search
USPC ..... 220/737–739; 229/403; 428/184
See application file for complete search history.

(56) References Cited

U.S. PATENT DOCUMENTS 4,462,444 A * 7/1984 Larson ..... B65D 81/3886 215/12.1
5,205,473 A * 4/1993 Coffin, Sr. ..... B65D 3/22 206/813
5,259,529 A * 11/1993 Coale ..... B65D 65/466 220/739
5,425,497 A * 6/1995 Sorensen ..... A47G 23/0216 220/738
5,826,786 A * 10/1998 Dickert ..... A47G 23/0216 229/403
5,830,548 A * 11/1998 Andersen ..... B28B 1/00 428/36.4
5,857,615 A * 1/1999 Rose ..... A47G 23/0216 220/737
6,039,682 A * 3/2000 Dees ..... B32B 3/28 493/58

(Continued)

FOREIGN PATENT DOCUMENTS

CN 201048795 * 8/2008
CN 101889806 * 4/2012
CN 106142675 * 3/2015

OTHER PUBLICATIONS

Machine Translation CN 101889806. (Year: 2015).*
Machine Trnaslation CN 106142675. (Year: 2012).*

*Primary Examiner* — Nina Bhat
(74) *Attorney, Agent, or Firm* — Fraline J. Allgaier

(57) ABSTRACT

A double-layered thermal insulation sleeve having a frusto-conical shape is disclosed. The sleeve is used on the outer surface of a cup to maintain a water and heat barrier. The sleeve is comprised of a first thermal insulation layer, a second thermal insulation layer, and longitudinal fold lines. The first thermal insulation layer being a cup facing layer that is constructed from non-woven polyester fiber having a plurality of interior air channels being retaining channels for fluids and heat being released from the cup. The second thermal insulation layer is constructed from embossed paper having outward facing bumps that provide a non-slip and thermally insulative gripping surface and a moisture barrier. The longitudinal fold lines allow the double-layered thermal insulation sleeve to be folded into a flattened configuration and stored for reuse.

15 Claims, 5 Drawing Sheets

(56) References Cited

U.S. PATENT DOCUMENTS

| | | | | |
|---|---|---|---|---|
| 6,182,855 | B1 * | 2/2001 | Alpert | A47G 23/0216 220/662 |
| 6,250,545 | B1 * | 6/2001 | Mazzarolo | B65D 81/3876 220/592.17 |
| 6,273,333 | B1 * | 8/2001 | Ward | A47G 23/0216 220/738 |
| 7,000,801 | B2 * | 2/2006 | Rodriguez | B65D 25/36 220/737 |
| 8,061,551 | B2 * | 11/2011 | Matlovich | B65D 25/34 220/737 |
| 8,424,712 | B2 * | 4/2013 | Cook | B65D 81/3876 220/737 |
| 10,011,696 | B2 * | 7/2018 | Leser | B32B 27/205 |
| 2004/0070223 | A1 * | 4/2004 | Wong | A47G 23/0216 294/31.2 |
| 2007/0215626 | A1 * | 9/2007 | Wright, Jr. | B65D 3/22 220/737 |
| 2009/0214837 | A1 * | 8/2009 | Albenice | B32B 7/12 428/195.1 |
| 2013/0043262 | A1 * | 2/2013 | Sanders | B32B 27/10 220/737 |
| 2013/0334073 | A1 * | 12/2013 | Frye | F42B 39/00 206/38 |
| 2017/0027774 | A1 * | 2/2017 | Ashraf | A61F 13/55115 |
| 2017/0245667 | A1 * | 8/2017 | Gaines | A47G 23/0216 |
| 2017/0369227 | A1 * | 12/2017 | Metzger | B65D 81/3886 |

* cited by examiner

DOUBLE-LAYERED THERMAL INSULATION SLEEVE

BACKGROUND OF THE INVENTION

Beverage sleeve holders are also known as coffee sleeves, coffee clutches, coffee cozies, hot cup jackets, paper zarfs, card-zarfs, cup snuggles and cup holders. Beverage sleeves are those tube-shaped to slide onto a disposable coffee cup to help you grip the cup better and also to help protect your fingers from the heat of the beverage by preventing your hands from burning while holding your hot beverage. By eliminating the need to double cup, they provide the company with a cost-savings. Most coffee sleeves are typically made of corrugated, textured paperboard. A good example of heat transfer can be felt when you buy a hot cup of coffee at your favorite coffee shop. The coffee heats the paper cup by conduction. The paper cup provides little insulation to protect your fingers from getting burned. Although paper is a fair insulator, the cup material is thin enough that the hot coffee heats it by conduction, making the outside surface hot to the touch. Our beverage container sleeve is an insulating container made of paper that is printed and embossed to simulate the bumpy texture inherent of an actual ball with the real leather feel of a football, basketball, baseball or soccer ball and may be personalized with an advertising message. The sleeve is easy to hold, reusable and recyclable. The inside of the sleeve is made of durable, high-quality polyester fiber, which has grooved air channels to allow for heat to escape. This means for heat to escape which protects your fingers from heat by preventing your hands from burning while holding their hot beverage with our sleeve. The inside of the sleeve is made from 100% post-consumer, recyclable plastic bottles which is made without depleting the earth's natural resources. The inner, durable, polyester fiber enables the inner and outer support for the outer walls. The air space created by the combination of the flutes line which allows for heat to escape between the inner and outer walls. The points are spaced apart enable the inner and outer walls to support, or reinforce, each other while at the same time minimizing the conduction of heat directly between the inner and outer walls. The lines through the first thermal insulation layer minimize the transference of heat from the hot beverage via hot air escaping upward and downward. The polyester, non-woven fiber, with combination of small lines of air channels throughout the first thermal insulation layer, is very efficient in insulation and in the process of slowing down or preventing conduction of heat. Because the polyester, non-woven fiber with air channels is so well insulated, heat is not transferred between the first thermal insulation and second thermal insulation. This is why you feel no heat when you wrap your hands around the second thermal insulation layer, which feels like and graphically depicts a cowhide or a pigskin leather football. Even as the first thermal insulation layer is insulating heat from the coffee, this layer is absorbing heat from the coffee cup. The beverage container sleeve is an insulated container with an outside texture of printed, embossed paper which simulates the real bumpy texture inherent to an actual ball with the real leather feel of a football, basketball, baseball or soccer ball. Also, the outer bumpy texture surface can be personalized with an advertising message or logo form any giving sport team, by creating a warm and friendly portable advertisement, which could reach millions. The inside of the sleeve is made of durable, high-quality polyester fiber, with unique air channels which allows for heat to escape. It provides heat insulation for the warm drink, as well as safety and comfort for the consumer. The container is easy-to-hold, reusable, and recyclable. All the materials that comprise the product are made from 100% post-consumer recyclable plastic bottles, produced without depleting the earth's natural resources. In order for a company to retain and build on its competitive edge, it must constantly seek innovative ways of bringing in new customers, as it simultaneously controls costs. This can be effectively accomplished by using sustainable production methods and materials. The reusable, recyclable sleeve would lead to a greater reduction in waste and energy consumption. Reusable sleeves have a bigger environmental impact than paper over time.

The reusable and recyclable beverage sleeve outer layer holder simulates the bumpy texture inherent to an actual ball with real leather feel of a football, basketball or baseball can expand to hold to hold 8, 10, 12, 16 and 20 oz hot beverage cup size. The sleeve can collapse and be flattened by having a metal foil liner that can then be folded over each other and joined.

The outer bumpy texture's durable design is water-resistant for easy cleaning and reuse. It keeps hot liquid from soaking though and can retain its mechanical strength against water compared to traditional paper pulp sleeves, meaning that the sleeves can be reused, which is an important characteristic of this invention: its durability. The double layer has a first and second ply which forms an interior region between them that is substantially filled. The first layer's texture is comprised of embossed paper that simulates the bumpy texture of a sport ball that is made up of paper. This texture is construction creates a better gripping surface, characteristically providing safe portability and a better grip. The second ply's inner texture that touches the cup is made from non-woven, high quality, polyester fiber with a combination of countless small lines of air channels, throughout the inner layer of the sleeve. This characteristic allows heat to escape are joined face to face relationship at a plurality of discrete bond site. The sleeve outer bumpy sport ball texture paper is made from recycled materials. The outer texture poly-coating, helps reduce any possible condensation accumulation which protects the outer of the sleeve from weakening. The top and bottom first and second openings are air channels extends from top to bottom providing isolated air channels within essentially an entire space between the liner and the flute, thereby reduce heat transfers that allows for heat to escape which protects and insulates your hand from the hot beverages. A need also exists for sport advertisers, marketers, companies and consumer alike to used more marketing tools that would be more environmental friendly and recyclable. In order for a company to retain and build on its competitive edge, it must constantly seek innovative ways of appealing to new customers, while simultaneously controlling costs and by using sustainable production methods. The reusable sleeve would lead to a greater reduction in waste and energy consumption. Reusable, sleeves have a bigger environmental impact than paper over time. A marketing tools that can be reused and recyclable in which the sleeve are comprise from 100% post-consumer recyclable plastic bottles; without deleting the earth's natural resources. This would be an environmental win-win.

BRIEF SUMMARY OF THE INVENTION

It is therefore an objective of the present invention to provide a double-layered thermal insulation sleeve having a frusto-conical shape and being used to cover the outer surface of a cup to maintain a water and heat barrier.

Another objective of the present invention is to provide a double-layered thermal insulation sleeve having a first thermal insulation layer operating as a cup facing layer and being constructed from non-woven polyester fiber. The non-woven polyester fiber having a plurality of interior air channels being disposed on the first thermal insulation layer in a multidirectional format and being retaining channels for fluids and heat being released from the cup and directing the heat and fluids away from the hands of a user.

Another objective of the present invention is to provide a double-layered thermal insulation sleeve having a second thermal insulation layer being constructed from embossed paper having outward facing bumps. The outward facing bumps providing a non-slip and thermally insulative gripping surface for a user.

Another objective of the present invention is to provide a double-layered thermal insulation sleeve having a second thermal insulation layer having poly-coating being applied thereon and wherein said poly-coating provides a moisture barrier by strengthening said second thermal insulation layer and prevents the absorption of liquid and heat.

Another objective of the present invention is to provide a double-layered thermal insulation sleeve having a plurality of longitudinal fold lines being arranged on said double-layered thermal insulation sleeve and allowing the double-layered thermal insulation sleeve to be folded into a flattened configuration along the longitudinal folds lines and stored for reuse.

Additional advantages and features of the present invention will become more apparent when considered in light of the following specification and drawings.

DETAILED DESCRIPTION OF THE INVENTION

The detailed description is for illustrative purposes and does not limit the scope of the present invention. The embodiments described below provide sufficient information to enable a person having ordinary skill in the art to practice the invention. It should be understood that other embodiments can be practiced with multiple variations without departing from the scope of the invention.

Figure 1:
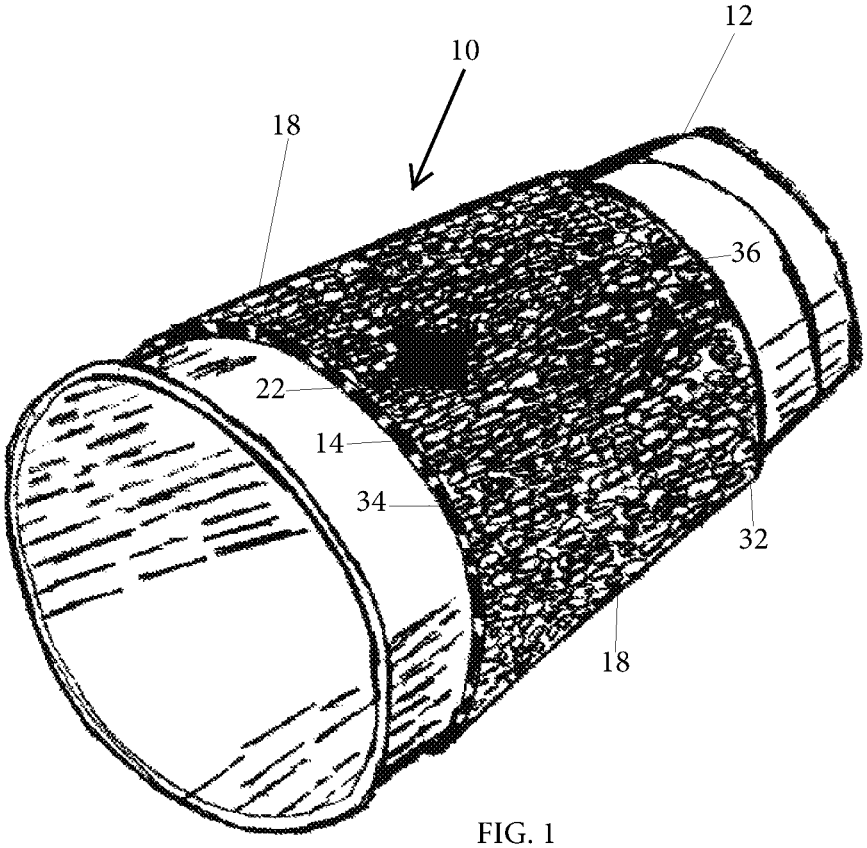
FIG. 1 is a perspective view of one embodiment of a thermal insulation sleeve being used on a cup.

Referring now to the drawings, FIG. 1 is an exemplary drawing of the preferred embodiment showing an assembled sleeve on a cup 12. The double-layered thermal insulation sleeve 10 has a frusto-conical shape and is used to cover the outer surface of a cup 12. The sleeve comprises a 14 thermal insulation layer, a second thermal insulation layer 16, and longitudinal fold lines 18. The first thermal insulation layer 14 is a cup facing layer and is constructed from non-woven polyester fiber. The non-woven polyester fiber has a plurality of interior air channels 22 being disposed on the first thermal insulation layer 14 in a multidirectional format. Bonding lines 24 are connected to the first thermal insulation layer 14 and forming a bonding site 26 with the second thermal insulation layer 16. An adhesive is used to fixedly attach the bonding lines 24 of the first thermal insulation layer 14 to the back side 28 of the second thermal insulation layer 16 for permanent connection to the second thermal insulation layer 16 and thereby creating a double-layered thermal insulation sleeve 10 wherein. The first thermal insulation layer 14 operates as a cup facing layer and the second thermal insulation layer 16 operates as a non-slip and thermally insulative gripping surface 32. The adhesive is placed between one of the bonding lines 24 and the respective back side of the second thermal insulation layer 16 in an overlapping relationship. The plurality of interior air channels 22 are retaining channels for fluids and heat being released from the cup 12. The fluid and heat are released in an upward and downward direction in the plurality of interior air channels 22 and from the upper channel edge 34 and the lower channel edge 36. The upper channel edge 34 and the lower channel edge 36 are release points for the heat from said first thermal insulation layer 14 and thereby directing the heat and fluids away from the hands of a user.

Figure 2:
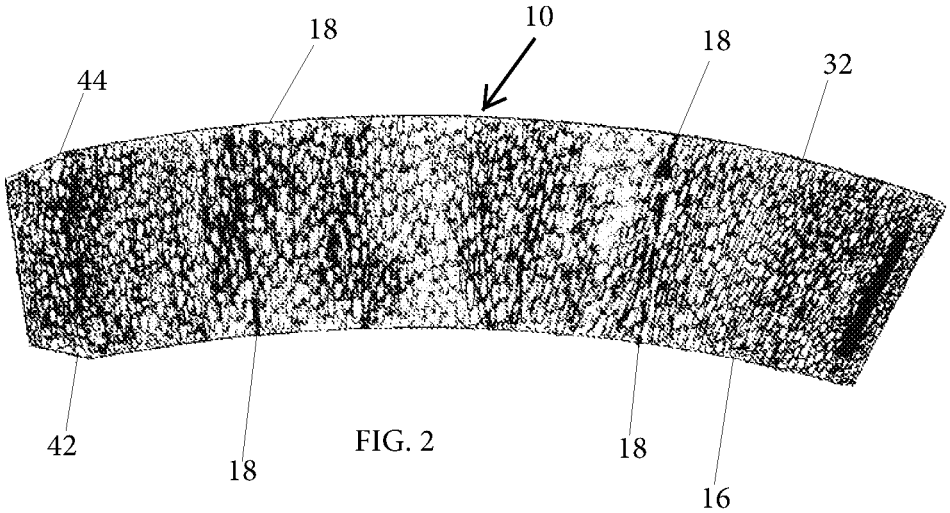
FIG. 2 is a front view of an unassembled thermal insulation sleeve.
Figure 3:
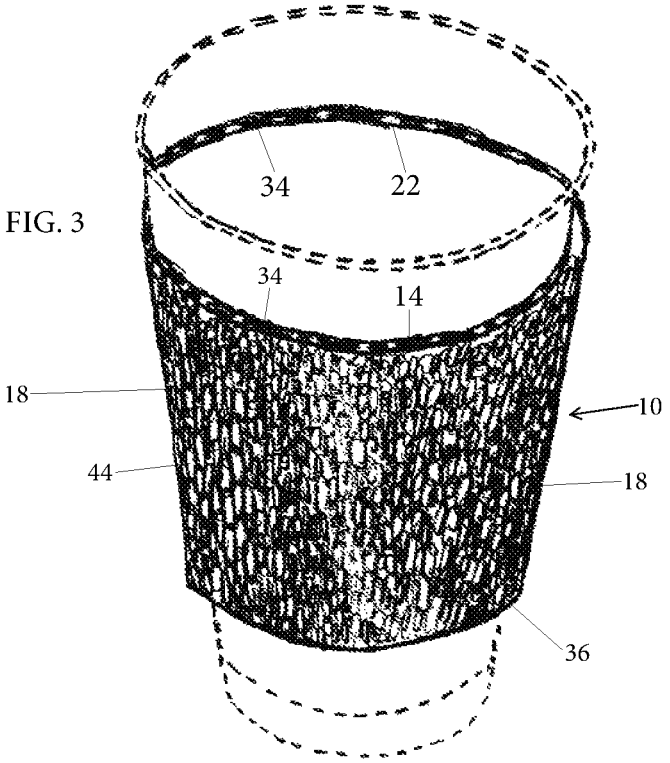
FIG. 3 is a perspective view of an assembled thermal insulation sleeve folded into a frusto-conical shape.

FIG. 2 shows a front a view of an unassembled sleeve. The outer layer 42 of the second thermal insulation layer 16 is constructed from embossed paper and has outward facing bumps 44 so as to provide a non-slip and thermally insulative gripping surface 32 for a user. The second thermal insulation layer 16 has poly-coating being applied thereon which provides a moisture barrier and additional strengthening. The second thermal insulation layer 16 prevents water and heat from permeating the second thermal insulation layer 16.

The plurality of longitudinal fold lines 18 can be seen in FIGS. 1-4. The lines are arranged on the double-layered thermal insulation sleeve 10 and allow the double-layered thermal insulation sleeve 10 to be folded into a flattened configuration and stored for reuse.

Figure 4:
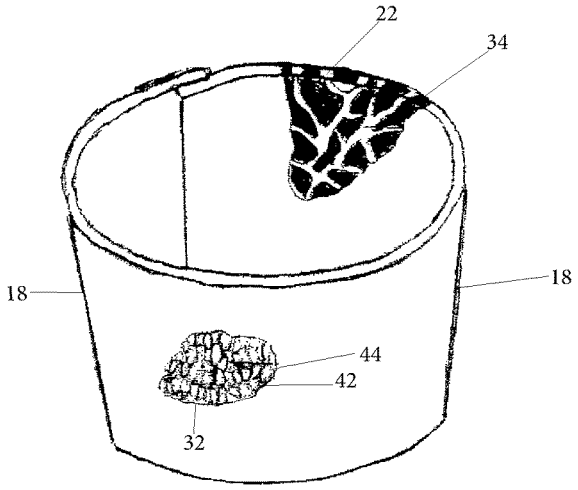
FIG. 4 is a top planar view of an assembled thermal insulation sleeve folded into a frusto-conical shape.

FIG. 4 shows a top planar view of an assembled sleeve that is folded into a frusto-conical shape and further illustrates the interior channels 22, upper channel edge 34, and the non-slip and thermally insulative gripping surface 32 of the second thermal insulation layer 16. The second thermal insulation layer 16 can be made of paper that is printed and embossed to simulate the bumpy texture inherent of an actual ball with the real leather feel of a football, basketball, baseball or soccer ball. This layer may also be personalized with advertising indicia.

Figure 5:
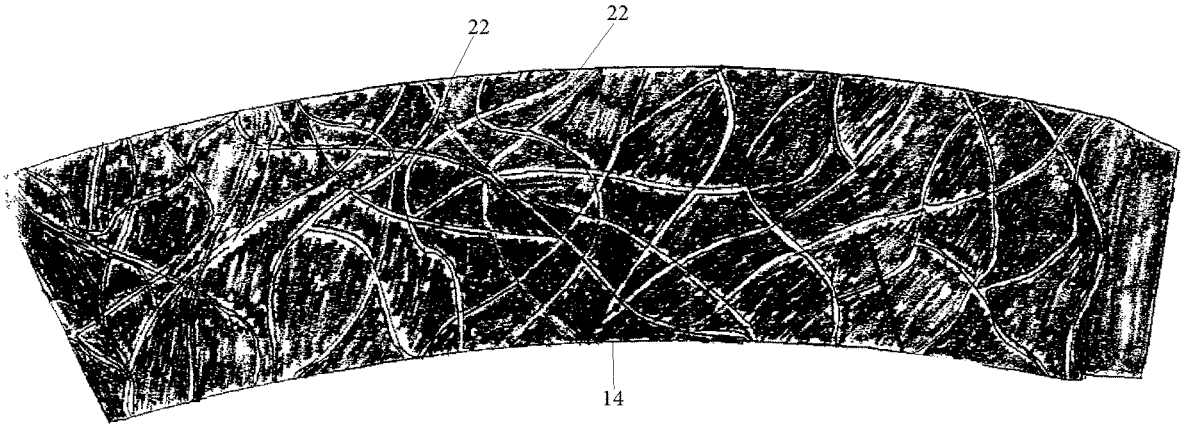
FIG. 5 is a back view of an unassembled thermal insulation sleeve.—

FIG. 5 shows a back view of the first thermal insulation layer 14. This layer supports the second thermal insulation layer 16 and houses a plurality of interior air channels 22 which are disposed on the first thermal insulation layer 14 in a multidirectional format.

Figure 6:
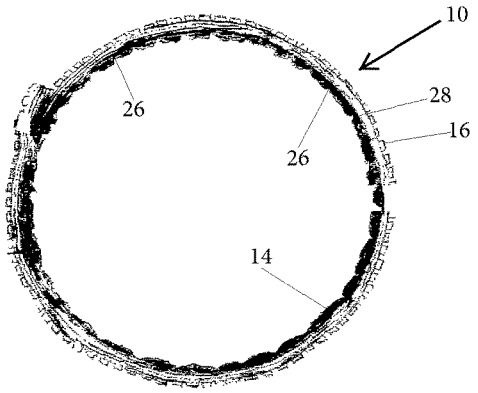
FIG. 6 is a cross-sectional view of a double-layered thermal insulation sleeve being folded into a frusto-conical shape.
Figure 7:
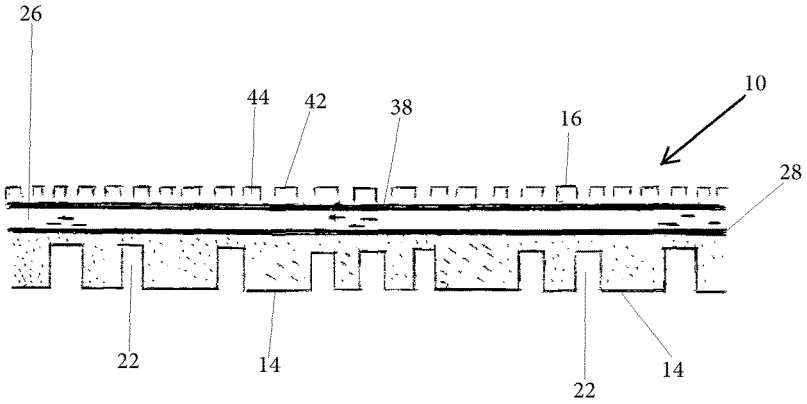
FIG. 7 is a cross-sectional view of a double-layered thermal insulation sleeve.

FIGS. 6 and 7 are cross sectional views of the double-layered thermal insulation sleeve 10. The first thermal insulation layer 14 is fixedly connected to the second thermal insulation layer 16. The non-woven polyester fiber features plurality of interior air channels 22 having a plurality of bonding lines 24 for connection to the back side of second thermal insulation 16. The plurality of air channels 22 are so spaced on the first thermal insulation layer 14 and the back side of the second thermal insulation layer 16 as to provide sufficient reinforcement for the second thermal insulation layer 16 while minimizing the conduction of heat directly between the first thermal insulation layer 14 and the second thermal insulation layer 16. The plurality of air channels 22 are randomly arranged and adhered to the back side of the second thermal insulation layer 16. The first thermal insulation layer 14 is sufficiently rigid to support the second thermal insulation layer 16 along the back surface of the second thermal insulation layer 16 while said double-layered thermal insulation sleeve 10 is being used. The second thermal insulation layer 16 may be formed from the group comprising: printing embossing, attaching, dying a pattern, cast, compression molded, injection molded, blow molded, extruded, and rotational cast and can have advertisement indicia being placed thereon.

What is claimed is:

1. A double-layered thermal insulation sleeve having a frusto-conical shape and being used to cover the outer surface of a cup to maintain a water and heat barrier, said sleeve comprising, a. a first thermal insulation layer, a second thermal insulation layer, and longitudinal fold lines, b. said first thermal insulation layer having an upper channel edge and a lower channel edge;

c. said second thermal insulation layer having a back side, a non-slip and thermally insulative gripping surface, and an outer layer;

d. said first thermal insulation layer being a cup facing layer and being constructed from non-woven polyester fiber, said non-woven polyester fiber having a plurality of interior air channels being disposed on said first thermal insulation layer, said plurality of interior air channels having a plurality of bonding lines for connection to said second thermal insulation layer and forming a bonding site with said second thermal insulation layer, adhesive being used for fixedly attaching said bonding lines of said first thermal insulation layer to said back side of said second thermal insulation layer for permanent connection to said second thermal insulation layer and thereby creating said double-layered thermal insulation sleeve wherein said first thermal insulation layer is a cup facing layer and said second thermal insulation layer is said non-slip and thermally insulative gripping surface, said adhesive being placed between one of said bonding lines and said back side of said second thermal insulation layer in overlapping relationship, said plurality of interior air channels retaining said water and heat that is released from said cup, said fluid and said heat being released in an upward and downward direction in said plurality of interior air channels and from said upper channel edge and said lower channel edge, said upper channel edge and said lower channel edge being release points for said water and said heat from said first thermal insulation layer and thereby directing said heat and said fluids away from the hands of a user;

e. said outer layer of said second thermal insulation layer being constructed from embossed paper having outward facing bumps so as to provide said non-slip and thermally insulative gripping surface for said user, said second thermal insulation layer having poly-coating being applied thereon and wherein said poly-coating provides a moisture barrier by strengthening said second thermal insulation layer and prevents said liquid and said heat from permeating said second thermal insulation layer;

f. said longitudinal fold lines being arranged on said double-layered thermal insulation sleeve and allowing said double-layered thermal insulation sleeve to be folded into a flattened configuration along said longitudinal folds lines and stored for reuse.

2. The plurality of air channels in claim 1 wherein said plurality of air channels are so spaced on said first thermal insulation layer and said back side of said second thermal insulation layer as to provide sufficient reinforcement for said second thermal insulation layer while minimizing the conduction of heat directly between said first thermal insulation layer and said second thermal insulation layer.

3. The plurality of air channels in claim 1 wherein said plurality of air channels are adhered to said back side of said second thermal insulation layer.

4. The first thermal insulation layer of claim 1 wherein said non-woven polyester fiber is made from 100% post-consumer recyclable plastic.

5. The first thermal insulation layer of claim 1 wherein said non-woven polyester fiber supports said second thermal insulation layer along said back surface of said second thermal insulation layer.

6. The second thermal insulation layer of claim 1 wherein said second thermal insulation layer is a moisture barrier.

7. The second thermal insulation layer of claim 1 wherein said second thermal insulation layer is a heat barrier.

8. The second thermal insulation layer of claim 1 wherein said second thermal insulation layer is adapted to repel stains.

9. The second thermal insulation layer of claim 1 wherein said second thermal insulation layer is selected from the group consisting of printing, embossing, attaching, dying a pattern, cast, compression molded, injection molded, blow molded, extruded, and rotational cast.

10. The second thermal insulation layer of claim 1 wherein said second thermal insulation layer is constructed from materials having thermo-resistant properties.

11. The second thermal insulation layer of claim 1 wherein said outer layer of said second thermal insulation layer has advertisement indicia being placed thereon.

12. The second thermal insulation layer of claim 1 wherein said outer layer of said second thermal insulation layer graphically depicts the outer surface of various types of sporting balls.

13. The second thermal insulation layer of claim 1 wherein said outer layer of said second thermal insulation layer has advertisement indicia being placed thereon.

14. The double-layered thermal insulation sleeve of claim 1 wherein said double-layered thermal insulation sleeve is sized for a variety of cup sizes.

15. The double-layered thermal insulation sleeve of claim 1 wherein said first thermal isolation layer and said second thermal insulation layer are folded over each other in a face to face configuration and joined to form said double-layered insulation sleeve.

* * * * *